US006102598A

United States Patent [19]

Hsu

[11] Patent Number: 6,102,598

[45] Date of Patent: Aug. 15, 2000

[54] LIPSTICK CASE

[76] Inventor: Shu-Wei Hsu, P.O. Box 82-144, Taipei, Taiwan

[21] Appl. No.: 09/224,101

[22] Filed: Dec. 31, 1998

[51] Int. Cl.[7] ..... A45D 40/06

[52] U.S. Cl. ..... 401/60; 401/59; 401/78; 401/82

[58] Field of Search ..... 401/60, 59, 78, 401/77, 82

[56] References Cited

U.S. PATENT DOCUMENTS

| | | | |
|---|---|---|---|
| 1,870,941 | 8/1932 | Barendse et al. | 401/59 |
| 2,486,073 | 10/1949 | Sommer | 401/59 |
| 3,445,171 | 5/1969 | Seidler | 401/59 |
| 3,617,138 | 11/1971 | Fukui | 401/59 |
| 3,737,241 | 6/1973 | Gordon et al. | 401/59 |
| 5,842,805 | 12/1998 | Pierpont | 401/78 |

FOREIGN PATENT DOCUMENTS

| | | | |
|---|---|---|---|
| 166111 | 10/1988 | Japan | 401/78 |

*Primary Examiner*—Henry J. Recla
*Assistant Examiner*—Kathleen J. Prunner
*Attorney, Agent, or Firm*—A & J

[57] ABSTRACT

A lipstick case includes an inner tubular member having an intermediate portion formed with two opposite Z-shaped slots. The inner tubular member has an upper end having a spherical portion on which are formed a pair of grooves. Each groove first extends slantwise from an upper edge to a lower edge and then extends horizontally along the surface of the lower edge. A pair of curved covers have a shape of a quarter of a sphere and a projection fitted in a respective one of the grooves. An intermediate tubular member is formed with a spiral groove and a flange close to a lower end of the intermediate tubular member. A tubular seat has an open top through which a lipstick is fitted therein, the tubular seat having a protuberance extending through the Z-shaped slot into the spiral groove. A rotatable base is rotatably fitted in a lower end of the intermediate tubular member and has a plurality of projections engaged with the holes of the inner tubular member. An outer tubular member is snugly fitted over the intermediate tubular member, whereby the lipstick case does not need a separate cap to close when not in use.

1 Claim, 4 Drawing Sheets

LIPSTICK CASE

BACKGROUND OF THE INVENTION

1. Field of the Invention

This invention is related to a lipstick case and in particular to one which does not need a separate cap to close when not in use.

2. Description of the Prior Art

Referring to FIG. 6, the conventional lipstick case generally includes an outer tubular member 40 formed with a spiral groove 41, an inner tubular member 50 fitted inside the outer tubular member 40 and formed with two Z-shaped slots 51, a socket 52 for receiving a lipstick 53 and having two protuberances 521 extending through the Z-shaped grooves to engage with the spiral groove 41, a base 42 for receiving the outer tubular member 40, and a cap 43. Nevertheless, once the cap 43 is lost, the whole lipstick has to be discarded thereby causing expenditure.

Therefore, it is an object of the present invention to provide an improvement in the structure of a lipstick case which can obviate and mitigate the above-mentioned drawbacks.

SUMMARY OF THE INVENTION

This invention is related to an improved lipstick case.

It is the primary object of the present invention to provide a lipstick case and in particular to one which does not need a separate cap to close when not in use.

It is another object of the present invention to provide a lipstick case and in particular to one which is convenient to use.

It is still another object of the present invention to provide a lipstick case and in particular to one which is easy to manufacture.

It is still another object of the present invention to provide a lipstick case and in particular to one which is simple in construction.

It is a further object of the present invention to provide a lipstick case and in particular to one which is fit for practical to use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
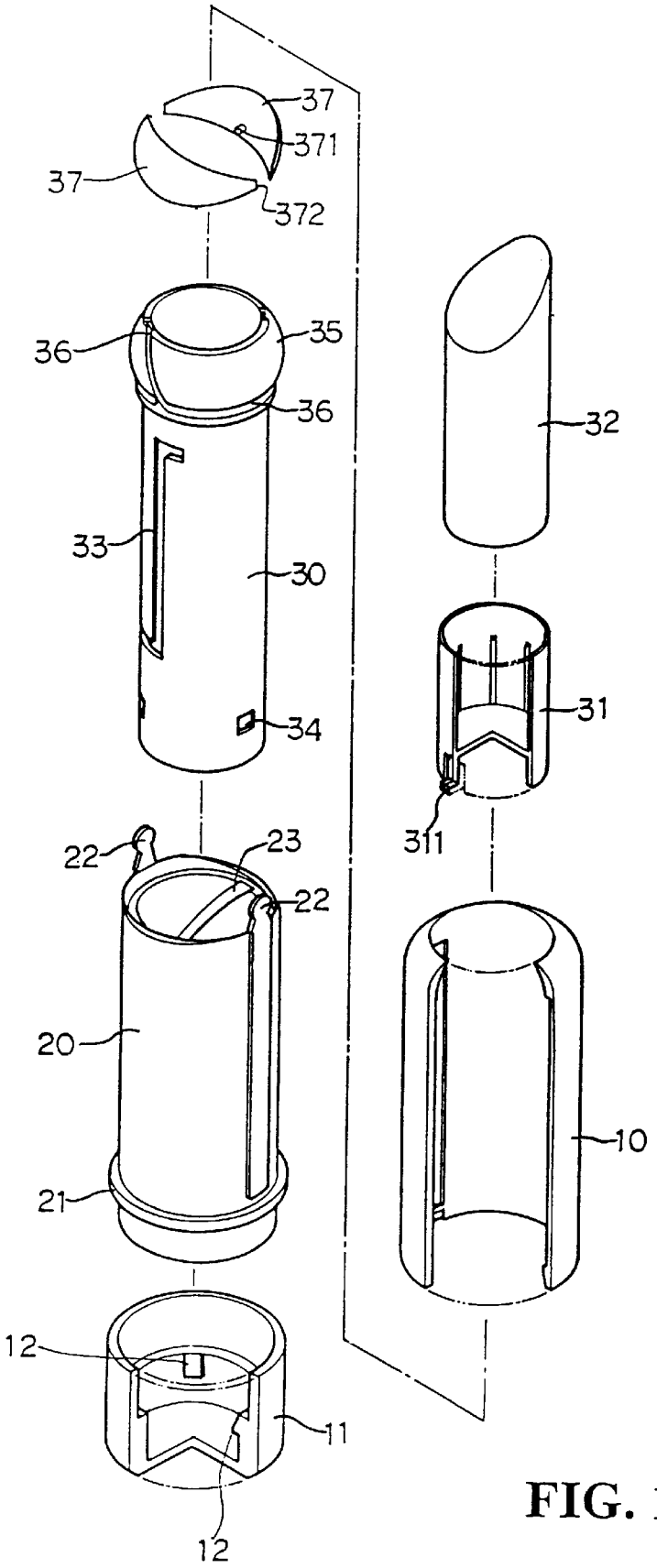
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
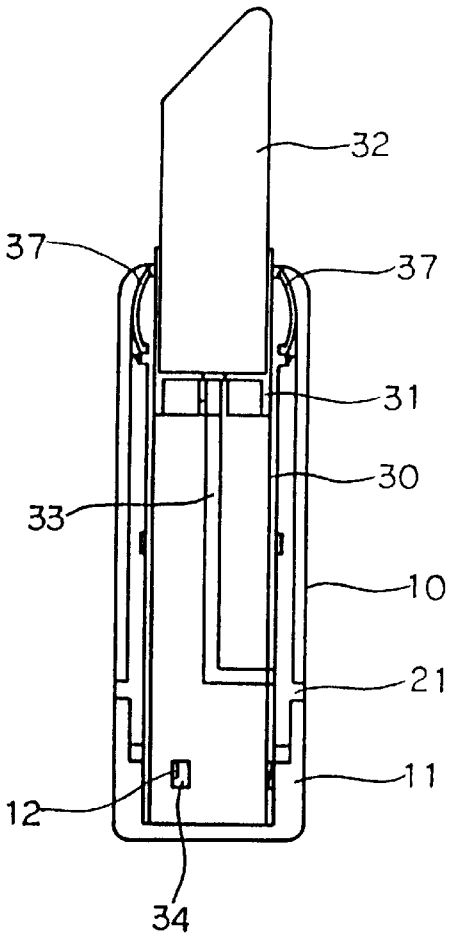
FIG. 2 and 3 illustrate the working principle of the present invention.

With reference to the drawings and in particular to FIGS. 1 and 2 thereof, the lipstick case according to the present invention generally comprises a lipstick 32, a tubular seat 31, an outer tubular member 10, a pair of curved covers 37, an inner tubular member 30, an intermediate tubular portion 20, and a rotatable base 11.

The inner tubular member 30 is formed with two opposite Z-shaped slots 33 at the intermediate portion and a plurality of holes 34 at the lower end. The upper end of the inner tubular member 30 has a spherical portion 35 on which are formed a pair of grooves 36. Each of the grooves 36 first extends slantwise from the upper edge to the lower edge and then extends horizontally along the surface of the lower edge. The groove 36 is designed so that the length of its horizontal portion is just equal to the rotating angle of the stroke of the slot 33 and its slant portion just corresponds to the stroke of the horizontal slot. A pair of curved covers 37, which are in the shape of a quarter of a sphere and have a projection 371, are engaged with the spherical portion 35 of the inner tubular member 30 with the projection 371 fitted in the corresponding groove 36. The curved cover 37 is further formed with a notch 372 at both ends thereof.

The inner tubular member 30 is fitted into the intermediate tubular member 20 the inner surface of which is provided with two opposite spiral grooves 23. The intermediate tubular member 20 is formed with a flange 21 close to its lower end and a pair of lugs 22 having a circular top end adapted to engage the notches 372 of the curved covers 37 that the curved covers 37 may rotate along the edge of the circular top end of the lugs 22.

The tubular seat 31 has two opposite protuberances 311 at the lower end and has an open top so that a lipstick 32 can be fitted inside. The tubular seat 31 is fitted inside the inner tubular member 30, with the protuberances 311 of the former extending through the Z-shaped slots 33 of the latter into the spiral grooves 23 of the intermediate tubular member.

The rotatable base 11 is formed with a plurality of projections 12 adapted to engage with the holes 34 at the lower end of the inner tubular member 30. The lower portion of the intermediate tubular member 20 is rotatably fitted in the rotatable base 11.

The outer tubular member 10 is snugly fitted over the intermediate tubular member 20.

Figure 3:
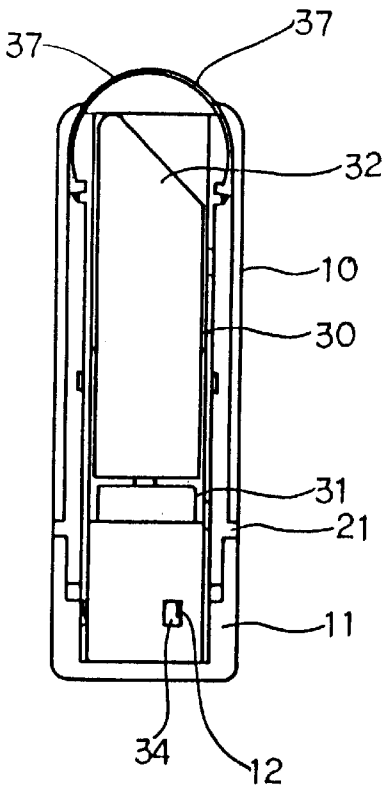
Figure 5:
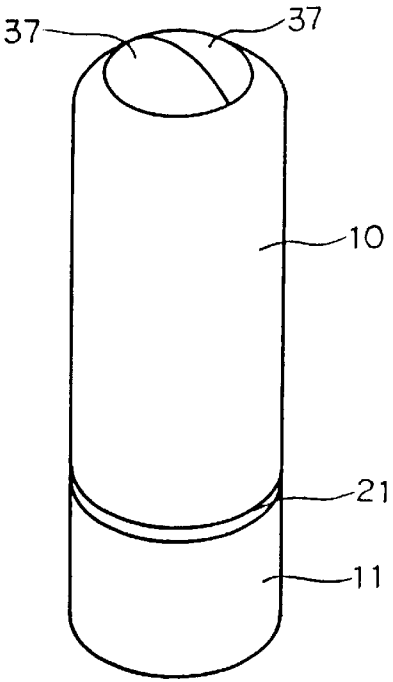
FIG. 5 is a perspective view of the present invention, with the curved covers at a closed position.
Figure 4:
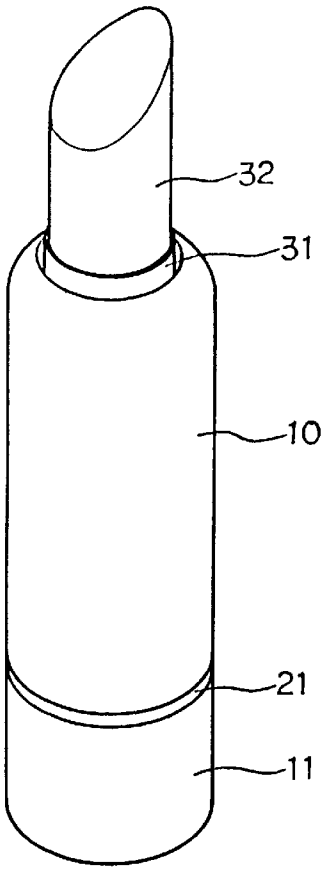
FIG. 4 is a perspective view of the present invention, with the lipstick extending upwardly out of the lipstick case.
Figure 6:
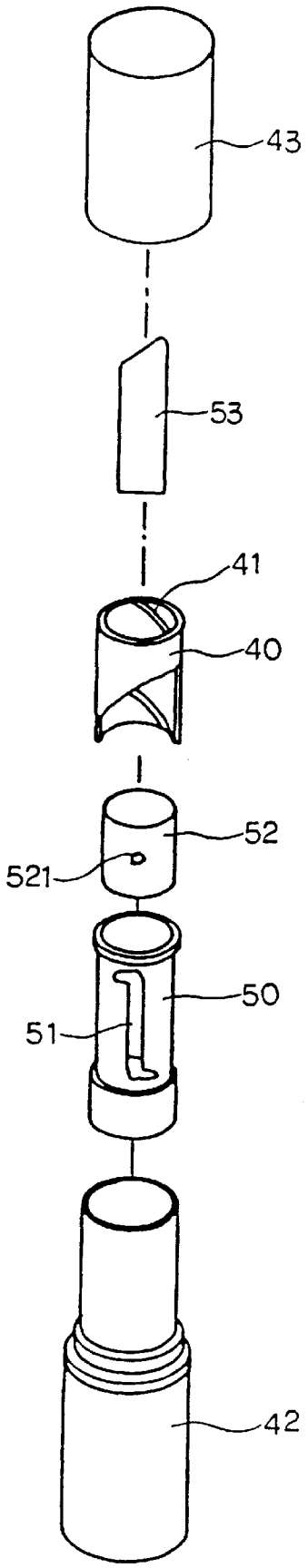
PRIOR ART FIG. 6
FIG. 6 is an exploded view of a prior art lipstick case.

When in assembly (see FIGS. 1, 2 and 3), the inner tubular member 30 is first fitted in the intermediate tubular member

20, with the lower end of the inner tubular member 30 engaged with the rotatable base 11. Then, the lipstick 32 is fitted in the tubular seat 31 which is fitted in the inner tubular member 30, with the protuberance 311 extending through the Z-shaped slot 33 of the inner tubular member 30 into the spiral groove 23 of the intermediate tubular member 20. Thereafter, the two curved covers 37 are engaged with the spherical portion 35 of the inner tubular member 30 with the projection 371 fitted in the corresponding groove 36. Finally, the outer tubular member 10 is snugly fitted over the intermediate tubular member 20. When in use, it is only necessary to rotate the rotatable base 11 relative to the outer tubular member 10 thereby turning the inner tubular member 30 to open the curved covers 37 and move the tubular seat 31 upwardly and therefore extending the lipstick 32 out of the outer tubular member 10. When not in use, simply turn the rotatable base 11 in a reverse direction to retract the lipstick 32 and close the curved covers 37.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A lipstick case comprising:

an inner tubular member having an intermediate portion formed with two opposite Z-shaped slots, said inner tubular member having an upper end having a spherical portion on which are formed a pair of grooves each first extends slantwise from an upper edge to a lower edge and then extends horizontally along said lower edge;

a pair of curved covers each having a shape of a quarter of a sphere and having a projection fitted in a respective one of said grooves, each of said curved covers having two ends each formed with a notch;

an intermediate tubular member formed with two opposite spiral grooves and a flange close to a lower end of said intermediate tubular member and a pair of lugs having a circular top end configured to engage with said notches of said curved covers;

a tubular seat having an open top through which a lipstick is fitted therein, said tubular seat having two opposite protuberances extending through said Z-shaped slots into said spiral grooves;

a rotatable base rotatably fitted in said lower end of said intermediate tubular member and having a plurality of projections engaged with holes in said inner tubular member; and an outer tubular member snugly fitted over said intermediate tubular member;

said holes in said inner tubular member being configured to receive said plurality of projections at an inner side of said rotatable base.

* * * * *